US005704486A

United States Patent [19]

Sopotyk et al.

[11] Patent Number: 5,704,486

[45] Date of Patent: Jan. 6, 1998

[54] STORAGE AND TRANSPORTATION CONTAINER FOR GRAIN TESTING EQUIPMENT

[76] Inventors: Mark Wayne Sopotyk; Dale Gordon Sopotyk; Barbara Lynn Sopotyk; Kim Frances Sopotyk, all of Box 22, Prud'homme, Saskatchewan, Canada, S0K 3K0

[21] Appl. No.: 440,938

[22] Filed: May 15, 1995

[51] Int. Cl.[6] ..... B65D 71/00

[52] U.S. Cl. ..... 206/569; 206/305

[58] Field of Search ..... 73/73; 206/305, 206/569, 320, 493, 232

[56] References Cited

U.S. PATENT DOCUMENTS

| | | | |
|---|---|---|---|
| 3,182,790 | 5/1965 | Bieganousky et al. | 206/305 |
| 3,487,914 | 1/1970 | Weaver et al. | 206/320 |
| 3,812,960 | 5/1974 | Falletta et al. | 206/394 |
| 4,583,399 | 4/1986 | Walsh et al. | 73/73 |
| 4,723,657 | 2/1988 | Robinson | 206/320 |
| 5,016,752 | 5/1991 | Haugen, Jr. | 206/232 |
| 5,178,290 | 1/1993 | Ota et al. | 215/382 |
| 5,405,012 | 4/1995 | Shindler et al. | 206/569 |
| 5,505,295 | 4/1996 | Whittington | 206/223 |

FOREIGN PATENT DOCUMENTS

| | | | |
|---|---|---|---|
| 428040 | 6/1945 | Canada . | |
| 491468 | 3/1953 | Canada . | |
| 608139 | 11/1960 | Canada . | |
| 703994 | 2/1965 | Canada . | |
| 857141 | 12/1970 | Canada . | |
| 55424 | 11/1943 | Netherlands | 206/305 |

*Primary Examiner*—William A. Cuchlinski, Jr.
*Assistant Examiner*—Andrew Hirshfield
*Attorney, Agent, or Firm*—Adrian D. Battison; Murray E. Thrift

[57] ABSTRACT

The present invention provides a container for the transportation and storage of grain testing equipment. The storage container encloses the grain testing equipment and comprises: a box, a first plurality of spaced apart raised projections to hold a grain moisture meter in place on the bottom of the box, a second plurality of spaced apart raised projections to hold a grain scale in place on the bottom of the box, a third plurality of spaced raised projections to hold a grain moisture meter load cell in place on the bottom of the box, and a raised elongate projection for holding grain moisture charts in place between the raised elongate projection and the rear wall. The container includes handles in the end walls for easy lifting and carrying.

4 Claims, 3 Drawing Sheets

STORAGE AND TRANSPORTATION CONTAINER FOR GRAIN TESTING EQUIPMENT

FIELD OF THE INVENTION

The present invention provides a container for the transportation and storage of grain testing equipment.

BACKGROUND

When testing the quality of grain in the field the equipment required to perform the tests must be transported from its stored location to the testing site. Often this equipment is heavy and is comprised of several apparatus. This makes it difficult for one individual to carry all the equipment needed without making a number of trips. As well the equipment is often susceptible to damage caused by impact, dust, or water.

When testing the moisture content of grain the grain testing equipment usually includes a moisture meter, a load cell for the moisture meter, a grain scale, and grain moisture charts. The grain moisture meter and grain scale are both somewhat heavy and cumbersome usually requiring the use of two hands to transport thus requiring that a number of trips be made when moving the equipment.

A transportation and storage container for use with grain testing equipment is needed particularly for equipment for testing the moisture content of grain, which is light weight, allows the user to carry all the equipment at once, and protects the equipment from damage caused by impact, dust, or water.

SUMMARY

According to the present invention there is provided a combination of a grain scale, a grain moisture meter, and a storage container therefor comprising: a box for fully enclosing a space having a rear wall, a bottom wall, a first side wall, and a second side wall, said walls being fixed relative to one another, and having a top wall being pivotally mounted such that the top wall can be opened by pivoting upwards and backwards, and a front wall being pivotally mounted such that the front wall can be opened by pivoting forwards and downwards; a grain moisture meter positioned within the box; a grain scale positioned within the box; a first plurality of spaced apart raised projections arranged on the inner surface of the bottom wall of the box for holding the grain moisture meter in place on the bottom wall; and a second plurality of spaced apart raised projections arranged on the inner surface of the bottom wall of the box for holding the grain scale in place on the bottom wall.

Preferably the first plurality of spaced apart raised projections engage the legs of the grain moisture meter and include a first pair of L-shaped spaced apart raised projections located adjacent the first side wall and rear wall, arranged such that each one of the raised L-shaped projections engages a respective leg on either side of the grain moisture meter. A second pair of L-shaped spaced apart raised projections are located adjacent the first side wall and spaced forwardly of the first pair of L-shaped projections, and are arranged such that each one of the raised L-shaped projections engages a respective leg on either side of the grain moisture meter.

Preferably the second plurality of spaced apart raised projections engage around a periphery of the grain scale and include a first pair of spaced apart raised projections located adjacent the second side wall, arranged such that one raised projection lies on either side of the grain weigh scale engaging the sides of said scale. A second pair of spaced apart raised projections are located spaced from the first pair in a direction longitudinal along the bottom wall, and are arranged such that one raised projection lies on either side of the grain weigh scale engaging the sides of the scale. A single raised projection is located spaced from the second pair in a direction longitudinal along the bottom wall, and arranged such that the raised projection engages an end of the scale opposite from the side wall.

Preferably the container includes a third plurality of spaced raised projections arranged on the inner surface of a bottom wall of the box comprising a circular raised projection for engaging in the depression in the bottom of a small grain moisture meter load cell, and a plurality of semicircular raised projections spaced outwards from and arranged concentrically with the circular projection for engaging in the depression in the bottom of a large grain moisture meter load cell. The third plurality of spaced raised projections is located adjacent the second side wall and the front wall.

Preferably the container includes a raised elongate projection arranged on the inner surface of the bottom wall spaced from the rear wall for holding a plurality of grain moisture charts in place between the raised elongate projection and the rear wall.

In the accompanying drawings, which illustrate an exemplary embodiment of the present invention:

BRIEF DESCRIPTION OF THE DRAWINGS

In the drawings like characters of reference indicate corresponding parts in the different figures.

DETAILED DESCRIPTION

Figure 2:
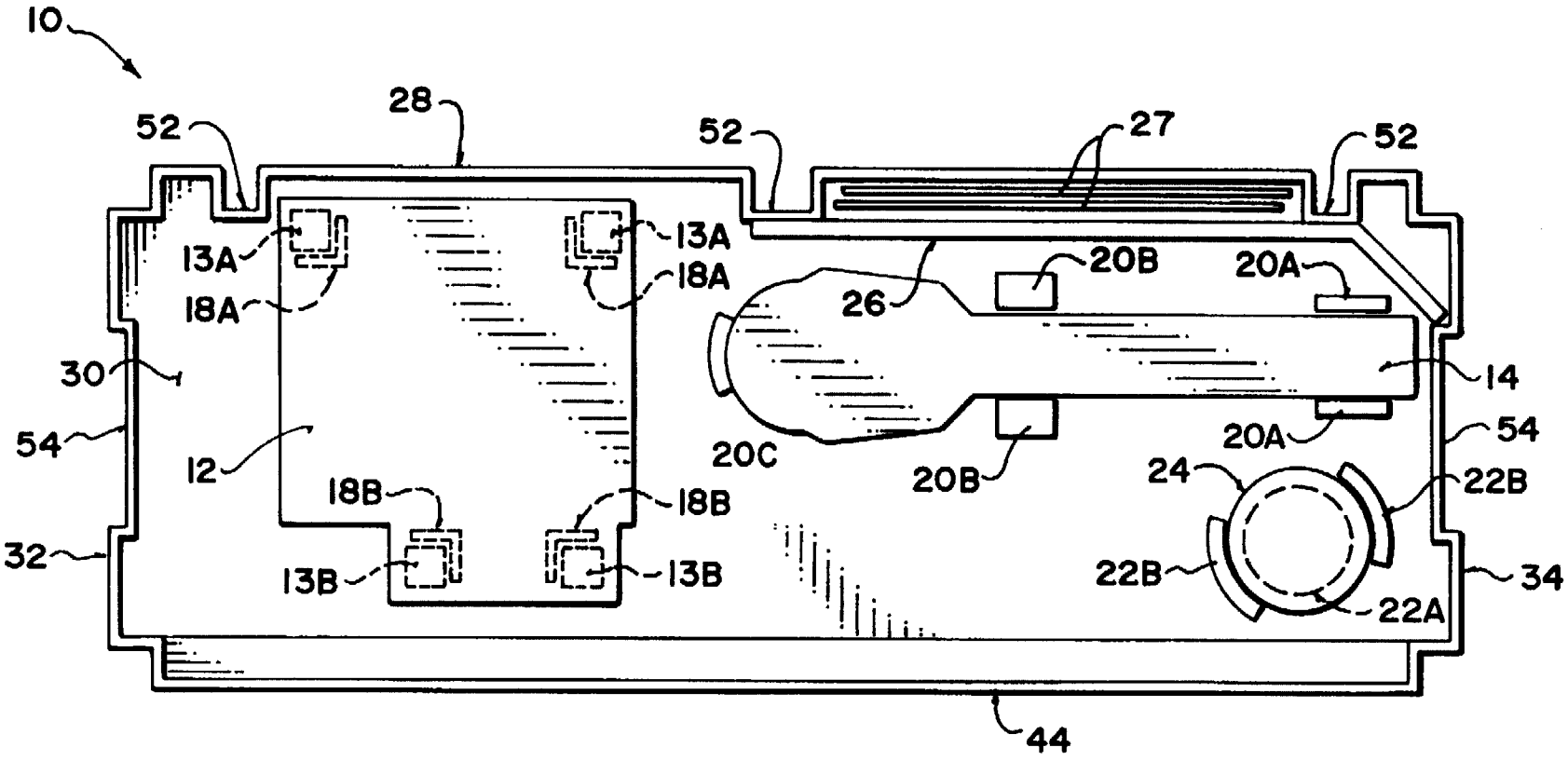
FIG. 2 is a top view of the container showing the grain testing equipment in place in the container.

Referring to FIG. 2 a preferred embodiment of the storage container is shown generally at 10. The container encloses a grain moisture meter 12 and a grain scale 14, and comprises a box 10, a first plurality of spaced apart raised projections 18*a* and 18*b* to hold the grain moisture meter 12 in place on the bottom of the box 10, and a second plurality of spaced apart raised projections 20*a*, 20*b*, and 20*c* to hold the grain scale 14 in place on the bottom of the box 10, a third plurality of spaced raised projections 22*a* and 22*b* to hold a grain moisture meter load cell 24 in place on the bottom of the box 10, and a raised elongate projection 26 for holding grain moisture charts 27 in place between the raised projection 26 and a rear wall of the box 10.

Referring to FIGS. 1, 2, 3 and 4 the box 10 is generally rectangular in shape, is made of molded plastics material, and fully encloses the space within. The box 10 has a rear wall 28, a bottom wall 30, a first side wall 32, and a second side wall 34. The rear 28, bottom 30, and side walls 32 and 34 are fixed relative to one another. A top wall 36 is pivotally mounted by a piano hinge 38 such that the top wall can be opened by pivoting upwards and backwards. The piano hinge 38 is located along a rear edge 40 of the top wall 36 and a top edge 42 of the rear wall 28. A front wall 44 is also pivotally mounted by a piano hinge 46 such that the front wall 44 can be opened by pivoting forwards and downwards.

The piano hinge 46 is located along a bottom edge 48 of the front wall 44 and a front edge 50 of the bottom wall 30.

Figure 1:
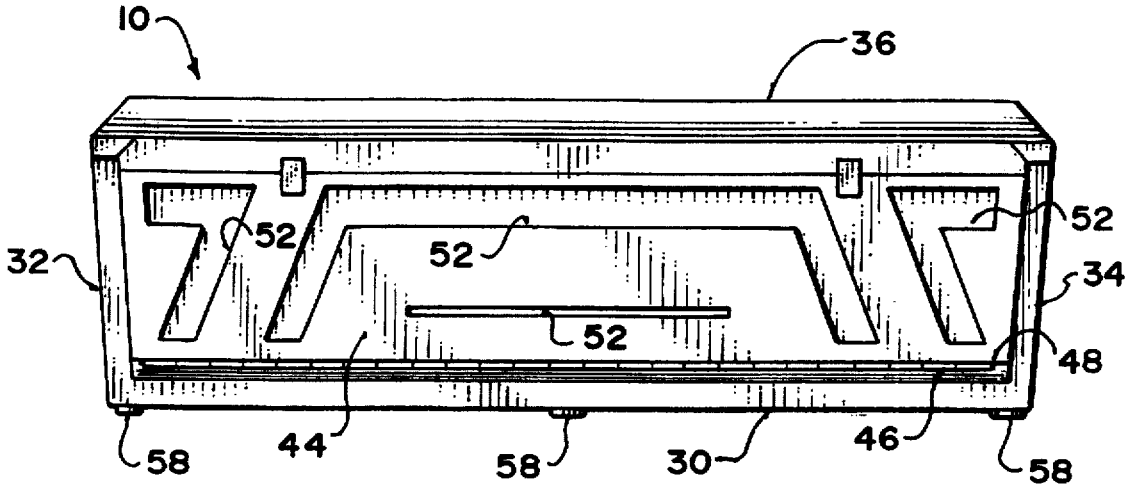
FIG. 1 is a front view of the container according to the present invention.
Figure 3:
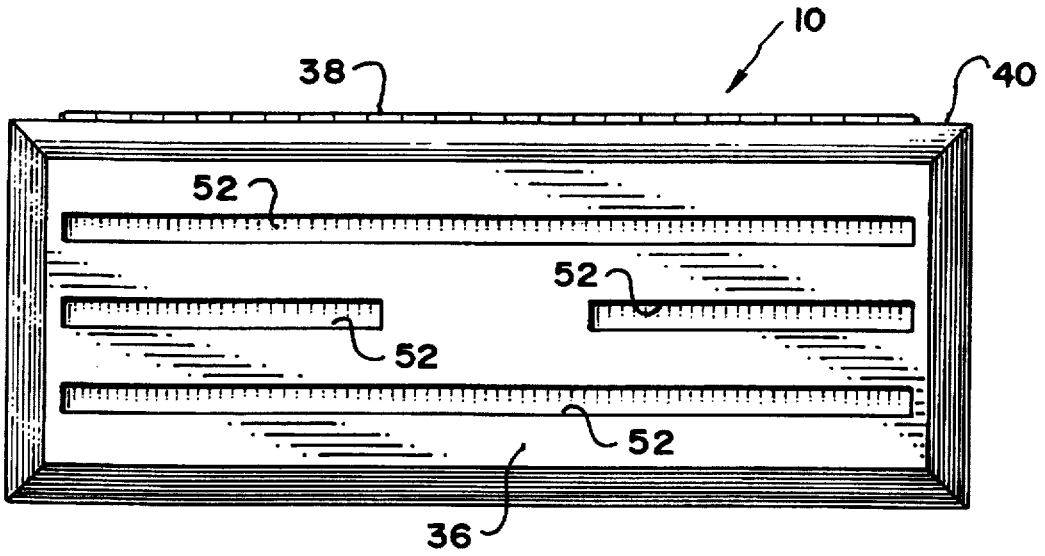
FIG. 3 is a top view of the container.
Figure 4:
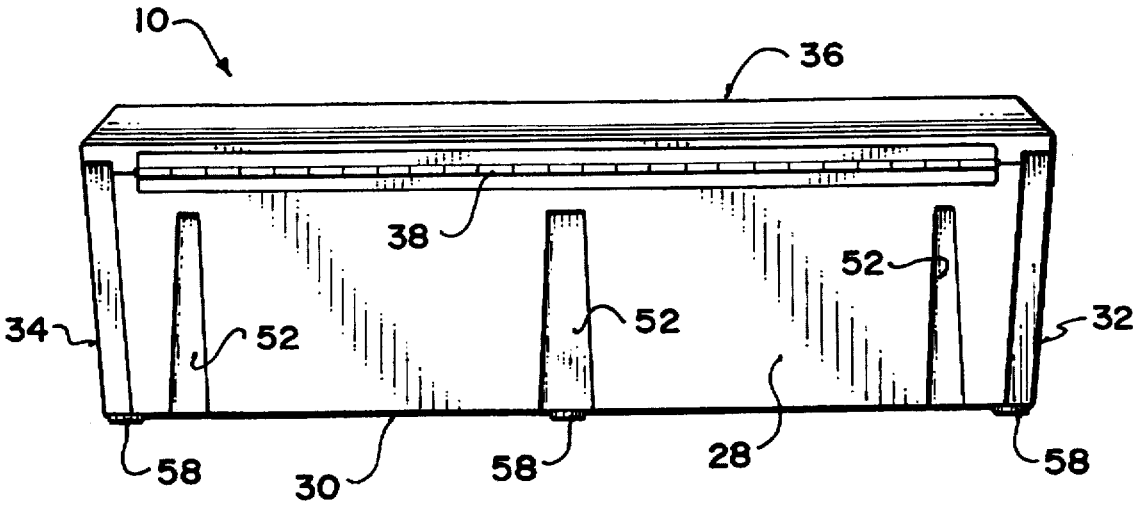
FIG. 4 is a back view of the container.

Referring to FIGS. 1, 3 and 4 the top 36, rear 28, and front 44 walls include reinforcing ribs 52 to add strength and rigidity to the walls. The reinforcing ribs 52 are indented into the surface of the walls. The top wall 36 includes four reinforcing ribs 52 arranged longitudinally across a top surface of the wall. The front wall 44 has three ribs 52 arranged across its surface and the rear wall 28 has three vertical ribs 52 spaced longitudinally across its surface.

Figure 5:
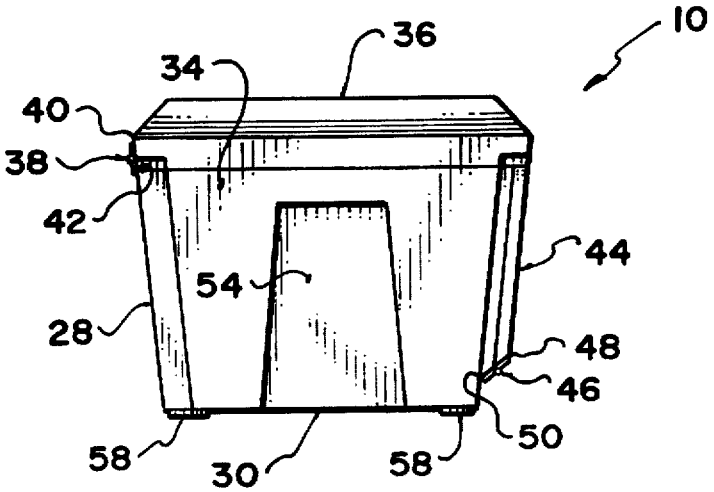
FIG. 5 is a side view of the container.

Referring to FIG. 5 the side walls 32 and 34 each have a handle 54 arranged on an outer surface to make the container easy to lift and carry. Each handle 54 is formed by an indentation in the outer surface. Indenting the handles 54 also provides additional strength and rigidity to the side walls 32 and 34 as the ribs do in the other walls.

The box 10 includes six legs 58 which project downwards from the bottom wall 30 of the box 10 for supporting the box 10 on a supporting surface. The legs 58 are molded as part of the bottom wall 30.

Referring to FIG. 2 the first plurality of spaced apart raised projections 18*a* and 18*b* are arranged on the inner surface of the bottom wall 30 of the box 10 for holding the grain moisture meter 12 in place on the bottom wall 30. The first plurality of spaced apart raised projections 18*a* and 18*b* include a first pair of L-shaped raised projections 18*a* and a second pair of L-shaped raised projections 18*b*. The first and second pairs of raised projections 18*a* and 18*b* hold the grain moisture meter 12 in place by engaging the legs 13*a*, 13*b* respectively of the grain moisture meter 12 thereby preventing motion of the meter across the bottom 30 of the box.

The first pair of raised projections 18*a* are located adjacent the first side wall 32 and the rear wall 28, and are arranged such that one raised L-shaped projection holds a respective one of the legs 13*a* of the grain moisture meter 12.

The second pair of raised projections 18*b* are located adjacent the first side wall 32 and are spaced forwardly of the first pair of L-shaped projections 18*a* towards the front of the box. The second pair 18*b* are arranged such that each one raised L-shaped projection engages a respective one of the legs 13b of the grain moisture meter 12.

The second plurality of spaced apart raised projections 20*a*, 20*b*, and 20*c* are arranged on the inner surface of the bottom wall 30 of the box 10 for holding the grain scale 14 in place on the bottom wall 30. The second plurality of spaced apart raised projections 20*a*, 20*b*, and 20*c* include a first pair of spaced apart raised projections 20*a*, a second pair of spaced apart raised projections 20*b*, and a single raised projection 20*c*. The first and second pairs of spaced apart raised projections 20*a* and 20*b*, and the single raised projection 20*c* hold the grain scale 14 in place by engaging around a periphery of the grain scale 14 thereby preventing motion of the scale across the bottom 30 of the box.

The first pair of spaced apart raised projections 20*a* are located adjacent the second side wall 34, and are arranged such that one raised projection lies on either side of the grain weigh scale 14 engaging the sides of the scale.

A second pair of spaced apart raised projections 20*b* are located spaced from the first pair 20*a* in a direction longitudinal along the bottom wall 30, and are arranged such that one raised projection lies on either side of the grain weigh scale 14 engaging the sides of the scale.

A single raised projection 20*c* is located spaced from the second pair 20*b* in a direction longitudinal along the bottom wall 30, and is arranged such that the raised projection 20*c* engages an end of the scale 14 opposite from the side wall 34.

The third plurality of spaced raised projections 22*a* and 22*b* are arranged on the inner surface of a bottom wall 30 of the box 10 for holding a small and large grain moisture meter load cell 24 in place on the bottom wall 30. The third plurality of spaced raised projections 22*a* and 22*b* comprises a circular raised projection 22*a* for engaging a depression in the bottom of a small grain moisture meter load cell 24, and a plurality of semicircular raised projections 22*b* spaced outwards from and arranged concentrically with the circular projection 22*a* for engaging a depression in the bottom of a large grain moisture meter load cell. The third plurality of spaced raised projections 22*a* and 22*b* are located adjacent the second side wall 34 and the front wall 44.

The raised elongate projection 26 is arranged for holding a plurality of grain moisture charts 27. The raised elongate projection 26 is located on the inner surface of the bottom wall 30 spaced a distance from the rear wall 28. The grain moisture charts 27 are placed between the raised projection 26 and the rear wall 28 for storage and transport.

In use the top 36 and front walls 44 of the container 10 are pivoted into the open position. The moisture meter 12 and grain scale 14 can then easily be placed through the front and top of the container into place on the bottom 30 of the container 10 with legs of the moisture meter 12 and the sides of grain scale 14 in contact with the corresponding respective raised projections of the first and second raised projections. The small and large moisture meter load cells are aligned and placed in contact with the third plurality of raised projects 22*a* and 22*b*, and the grain charts 27 are placed in the container 10 between the raised elongate projection 26 and the rear wall 28.

The top 36 and front 44 walls are then pivoted into a closed position thereby fully enclosing the grain testing equipment protecting it from possible rain, dust, and impact damage. The grain testing equipment can now easily be moved to a new location, or into a vehicle, all at once, by lifting the container by the handles 54 and carrying it.

In alternative embodiments the reinforcing ribs 52 and handles 54 on the walls of the container can project outwardly from the walls instead of being indented into the walls.

While one embodiment of the present invention has been described in the foregoing, it is to be understood that other embodiments are possible within the scope of the invention. The invention is to be considered limited solely by the scope of the appended claims.

We claim:

1. Apparatus for use in testing grain comprising:

an integral box for fully enclosing a space having a rear wall, a bottom wall, a first side wall, and a second side wall, said walls being fixed relative to one another, and having a top wall which is pivotally mounted adjacent a rear edge of the top wall such that the top wall can be opened by pivoting upwards and backwards, and a front wall which is pivotally mounted adjacent a bottom edge such that the front wall can be opened by pivoting forwards and downwards, the box being transportable as an integral unit;

a grain moisture meter located within the box having four legs for supporting the meter;

four projections each of which is L-shaped in plan view standing upwardly from the bottom wall of the box each engaging and locating a respective one of the legs such that the grain moisture meter is held fixed in place in the box standing on top of the bottom wall, the four projections including a first pair adjacent the rear wall and a second pair adjacent the front wall, the meter being located adjacent the first side wall;

a grain scale located within the box for weighing a quantity of grain, the grain scale having a body with a periphery;

a second plurality of projections standing upwardly from the bottom wall for engaging the periphery and holding the grain scale fixed in place in the box standing on top of the bottom wall, the second plurality of projections including a first pair of projections each arranged on a first respective side of the body of the scale, a second pair of projections each arranged on a second respective side of the body of the scale, the pairs of the second plurality of projections being arranged at positions spaced along the bottom wall with the second pair of the second plurality of projections adjacent the second side wall and a third projection at an end of the body of the scale which is opposite to the second side wall;

a load cell positioned within the box, the load cell having a recess therein;

and a projecting member on the bottom wall which projecting member has a wall which is circular in plan view onto which the recess in the load cell is engaged thus locating the load cell in the box;

whereby the moisture meter, scale and the load cell can be transported in the box to a testing site.

2. The apparatus according to claim 1 including a plurality of grain moisture charts wherein the box includes an elongate member spaced from an inside surface of the rear wall for holding the plurality of grain moisture charts in place in the box between the elongate member and the inside surface of the rear wall.

3. The apparatus according to claim 1 wherein the projecting member on the bottom wall of the box is located adjacent the second side wall and the front wall of the box.

4. The apparatus according to claim 1 wherein the projecting member on the bottom wall of the box includes portions spaced outwardly from and arranged concentrically with the circular wall for engaging in a recess in the bottom of a second load cell of larger diameter than said load cell.

* * * * *